US007168197B2

(12) United States Patent
Siegenthaler

(10) Patent No.: US 7,168,197 B2
(45) Date of Patent: Jan. 30, 2007

(54) SYSTEM AND METHOD FOR MOUNTING A SIGN

(76) Inventor: John Siegenthaler, 795 Woodhill Rd., Mansfield, OH (US) 44907

( * ) Notice: Subject to any disclaimer, the term of this patent is extended or adjusted under 35 U.S.C. 154(b) by 0 days.

(21) Appl. No.: 11/138,716

(22) Filed: May 26, 2005

(65) Prior Publication Data

US 2005/0262743 A1 Dec. 1, 2005

Related U.S. Application Data

(60) Provisional application No. 60/574,890, filed on May 27, 2004.

(51) Int. Cl.
*G09F 17/00* (2006.01)

(52) U.S. Cl. ..... 40/603; 38/102.91; 160/378; 160/404

(58) Field of Classification Search ..... 40/603–604; 160/378, 404; 38/102.91
See application file for complete search history.

(56) References Cited

U.S. PATENT DOCUMENTS 1,819,776 A * 8/1931 Heck ..... 359/445
1,882,454 A * 10/1932 Spalding ..... 160/353
1,987,921 A * 1/1935 Bertsch ..... 160/378
2,379,499 A * 7/1945 Smith ..... 160/378
4,006,771 A * 2/1977 Spurkel ..... 160/378
4,754,566 A 7/1988 Gordon
4,800,947 A * 1/1989 Loomis ..... 160/368.1
6,088,942 A 7/2000 Brooks et al.

FOREIGN PATENT DOCUMENTS

FR 2662839 A * 12/1991

* cited by examiner

*Primary Examiner*—Cassandra Davis
(74) *Attorney, Agent, or Firm*—Fay, Sharpe, Fagan, Minnich & McKee, LLP

(57) ABSTRACT

A system and method for mounting a flexible material sign to a billboard structure includes a plurality of tensioning clamps affixed to the billboard structure. Each of the plurality of clamps includes a bracket adapted to be secured to the billboard structure and an adjustable J-bolt moveably secured to the bracket. The J-bolt includes a hooked section for passing through and hanging the flexible material sign to the billboard structure. To tautly mount the flexible material sign to the billboard structure, the brackets are secured to the billboard structure with fasteners. The hooked sections of the J-bolts are passed through the sign to hang the sign from the billboard structure. The J-bolts are adjusted relative to the bracket to hang the sign a preselected distance from the billboard structure and to apply a tension to the sign to maintain a desired tautness of the sign.

17 Claims, 3 Drawing Sheets

SYSTEM AND METHOD FOR MOUNTING A SIGN

This application claims the priority benefit of U.S. application Ser. No. 60/574,890, filed May 27, 2004, the disclosure of which is incorporated herein by reference.

BACKGROUND

This invention relates generally to signs and banners and, more particularly, to a system and method for tautly mounting a sign or banner such as a flexible material sign or banner to a structure. The invention is particularly applicable to a billboard type of structure in that it allows a flexible material display, such as a large vinyl sheet having printed advertising or other information thereon, to be tautly mounted to a billboard structure or frame, while alternately allowing a pasted or painted sign to be applied to the billboard structure or frame and be viewed thereon when the flexible material display is not in use. It will be appreciated, however, that the invention may be adapted to effective use in other environments and applications.

Techniques for securing or adding large display advertisements and messages to billboard structures or frames are well known. Billboard structures can include conventional free-standing billboards, such as those often found along a roadside or on the roof of a building; sides of buildings, often large areas without windows or many architectural features; side walls of conventional tractor trailers; and the like. Often, the billboard structure includes a plurality of substantially planar panels mounted adjacent one another to form a large, flat area to accommodate the advertisement or message.

One known method of adding a large display advertisement to a billboard structure is to paint an advertisement image directly on the panels of the billboard structure. This often requires the use of an artist to perform the painting for each billboard structure which undesirably increases the cost of billboard advertising. Another known method, widely in use today, is to paste preprinted signs over the panels of the billboard structure. While this approach eliminates the need for an artist to craft each advertising image for each billboard, pasting suffers several of its own drawbacks.

In particular, pasted signs are often difficult to remove and replace as they require the old sign to be pasted over, painted over, or scraped off prior to the application of a new pasted sign. The signs are often large and high off the ground which makes these tasks rather cumbersome and a skilled laborer is often required for properly pasting the sign to the billboard structure. Further, pasted signs are vulnerable to peeling and deterioration, particularly if they frequently encounter inclement weather. Like painting, these problems undesirably increase the cost of billboard or banner type advertising.

More recently, flexible material signs or displays, often constructed of vinyl, are being used on billboard or other structures capable of carrying a flexible sign. These signs are generally lightweight and relatively inexpensive to manufacture. A variety of methods are known for mounting these types of signs to billboard structures. One such method is to wrap the flexible material sign around a show surface of the billboard structure and tie opposing edges of the sign together using cord material or the like. Another method is to install elongated members or rods through hemmed edges formed in the sign and secure the elongated members to a billboard structure via cord or some other mounting device. While these methods achieve inexpensive installation costs, they often result in flexible material signs that are unsightly because the cords or other connecting devices mounting the signs remain largely exposed and/or the signs themselves do not remain taut.

In response to advertisers and billboard owners who desire a more professional appearance, numerous mounting devices have been proposed for mounting flexible material signs to billboard structures. For example, mounting devices for securing flexible material signs are disclosed in U.S. Pat. No. 4,754,566 issued on Jul. 5, 1988 and U.S. Pat. No. 6,088,942 issued on Jul. 18, 2000. While these types of mounting devices may result in a more professional appearance, they are often overly elaborate and expensive to manufacture, install and use. Accordingly, there is a need for an effective mounting system and method for securing flexible material signs to billboard structures while balancing the competing desires of advertisers in the appearance and cost of the mounting system and method.

SUMMARY

In accordance with one embodiment, a system and method for mounting a sign are advantageously provided. The system has a plurality of tensioning clamps affixed to an associated billboard structure or frame. Each clamp includes a bracket adapted to be secured to an associated billboard structure and an adjustable J-bolt movably secured to the bracket. Each J-bolt includes a hook section for passing through and hanging an associated flexible material sign, such as a vinyl sign having a printed advertisement thereon, to the billboard structure. Further, each of the J-bolts is adjustably moveable along a first axis to selectively apply a tension to the associated flexible material sign to ensure, in conjunction with the other J-bolts, that the sign is taut.

Each of the J-bolts is also adjustably movable along a second axis for positioning the associated sign a selected distance from a show surface of the billboard structure. A first threaded member or nut received on a threaded section of the J-bolt counteracts the tension force applied to the sign for maintaining the J-bolt in a selected position along the first and second axes. A second threaded member or jam nut abuts the first threaded member and locks the J-bolt in the selected position.

The method includes securing the clamps with J-bolts to the billboard structure by fasteners. The J-bolt hook sections are received through the associated flexible material sign to hang the sign from or to the billboard structure. The J-bolts are adjusted to hang the associated sign a preselected distance from the billboard structure and to apply a tension to the associated sign to maintain a desired tautness of the sign. The first threaded member of each J-bolt is positioned to maintain the J-bolt in a selected position, and the second threaded member is moved to an abutting position to lock the J-bolt in the selected position.

A principal advantage of the present invention is found in the provision of a system and method for tautly mounting a flexible material sign to a billboard structure or frame.

Another advantage of the invention resides in the provision of a system and method for mounting a flexible material sign that is both inexpensive and aesthetically appealing.

Still another advantage resides in a system and method for mounting a flexible material sign that is relatively simple to manufacture and use.

Yet another advantage of the present invention is the provision of a system for mounting a flexible material sign that alternately allows a pasted sign to be used on a billboard structure when no flexible material sign is in use.

Still yet another advantage of the present invention is found in a system for mounting a flexible material sign that can be easily and readily adapted to existing billboard structures or frames of varying types.

Still other advantages and benefits of the invention will become apparent to those skilled in the art and upon reading and understanding the following detailed description.

BRIEF DESCRIPTION OF THE DRAWINGS

The invention may take physical form in certain parts and arrangements of parts, one or more embodiments of which will be described in detail in this specification and illustrated in the accompanying drawings which form a part hereof and wherein.

DETAILED DESCRIPTION

Figure 1:
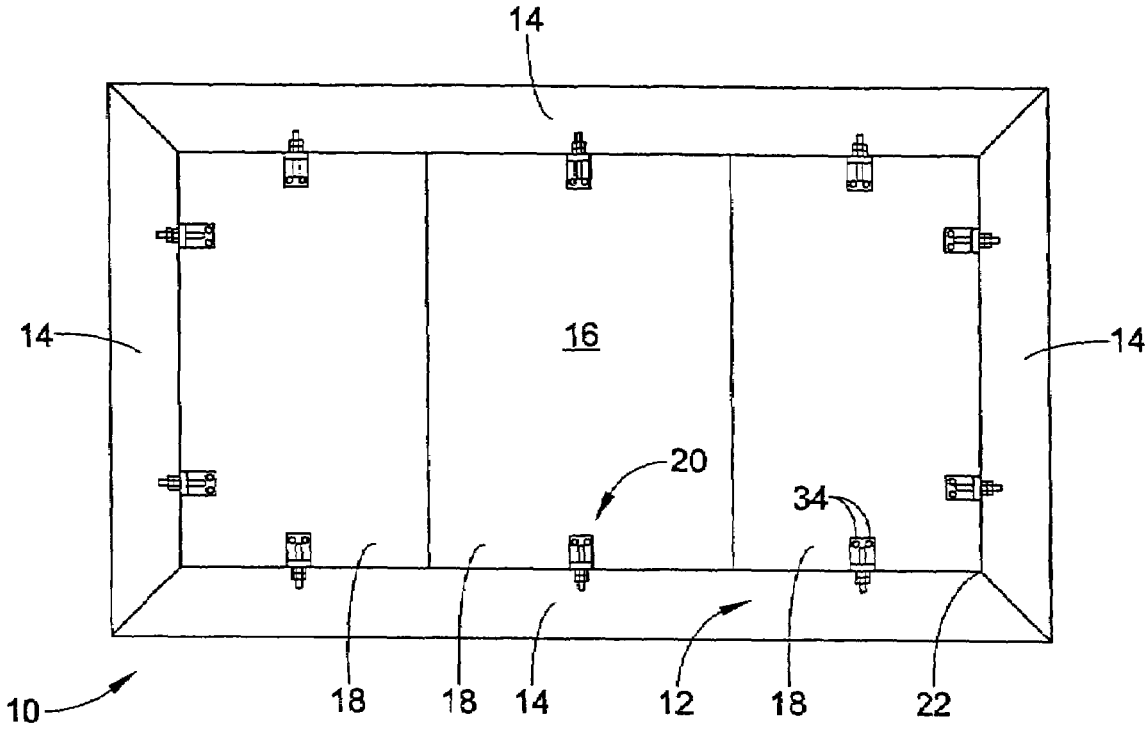
FIG. 1 is an elevational view of a billboard structure having a plurality of tension clamps mounted thereon for hanging a flexible material sign from a billboard structure or frame.

Referring now to the drawings wherein the showings are for purposes of illustrating one or more embodiments and not for purposes of limiting the same, FIG. 1 shows a billboard structure generally designated by reference numeral 10. The billboard or sign carrying structure of the illustrated embodiment includes a rectangular frame 12 formed of four elongated frame members 14 and a show surface 16 formed of a plurality of substantially planar panels 18 positioned adjacent one another. The panels 18 are secured to the frame 12 in a conventional manner. The show surface 16, also referred to herein as a poster face, provides a large, substantially planar area for displaying a sign on the billboard structure 10 as will be described in more detail below.

A plurality of tension clamps 20 are mounted to the show surface 16 at spaced intervals along interior edges of the frame 12. In the preferred embodiment, the clamps 20 are spaced apart at intervals of approximately three (3) feet, and several of the clamps are positioned adjacent corners 22 of the billboard structure as defined at intersections of the frame members 14. Of course, the exact positioning of the clamps and the spacing therebetween could vary as could the number of clamps used on a particular billboard structure. For example, on a relatively large billboard structure, it may be desirable to utilize many more clamps 20, whereas it may be possible and/or desirable to use relative fewer clamps 20 on a relatively small billboard.

Figure 2:
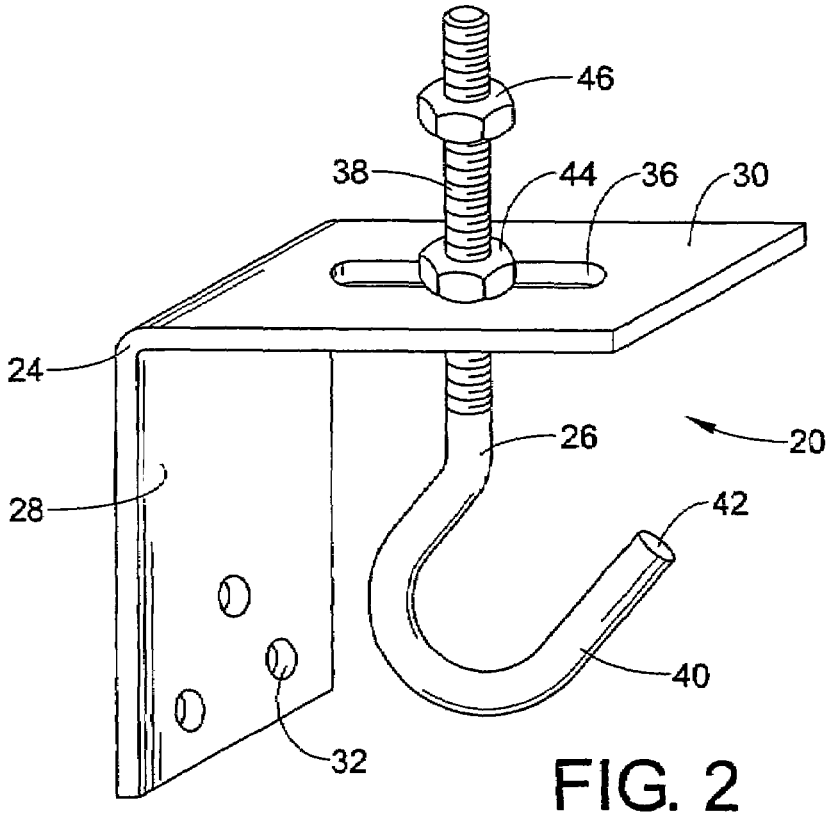
FIG. 2 is a perspective view of one of the plurality of tension clamps of FIG. 1.

With additional reference to FIG. 2, each tension clamp 20 comprises a generally L-shaped bracket 24 and a J-bolt 26 moveably secured to the L-shaped bracket. More specifically, the bracket 24 includes a first leg section 28 and a second leg section 30 extending approximately normal to the first leg section. The first leg or clamp section 28 defines a plurality of apertures 32 therethrough (three apertures in the illustrated embodiment) for mounting the clamp 20 to the show surface 16 of the billboard structure. Specifically, with reference back to FIG. 1, suitable fasteners 34, such as self-tapping metal screws, are received through the apertures 32 for securing the bracket 24 to the billboard structure.

With reference again to FIG. 2, the second leg section 30 defines a slot 36 extending along a longitudinal length of the second leg section. A width of the slot 36 is appropriately sized to receive a threaded shaft portion 38 of the J-bolt 26, also referred to herein as a hook. Thus, the J-bolt extends through the second leg section 30 along a first axis generally parallel with a longitudinal length of the first leg section 28. As will be described in more detail below, the J-bolt 26 is movable along the first axis by moving into or out of the slot 36 and along a second axis parallel to the slot (and the longitudinal length of the second leg section 28) by moving along the slot. A hooked section 40 of the J-bolt is oriented such that an end 42 of the J-bolt adjacent the hook section 40 faces outwardly in a direction opposite the first leg section 28.

A first threaded member 44, such as a conventional hexagonal nut, is threadedly received on the threaded shaft portion 38 of the J-bolt and abuts the second leg portion 30. The first threaded member maintains the J-bolt in a preselected position along both the first and second axes. A second threaded member or jam nut 46, shown spaced apart from the first threaded member 44, is also threadedly received on the threaded shaft portion 38. The jam nut 46 can be threadedly advanced to a position wherein the jam nut is in abutting relation with the first threaded member 44 to effectively lock the J-bolt in the preselected position.

Figure 3:
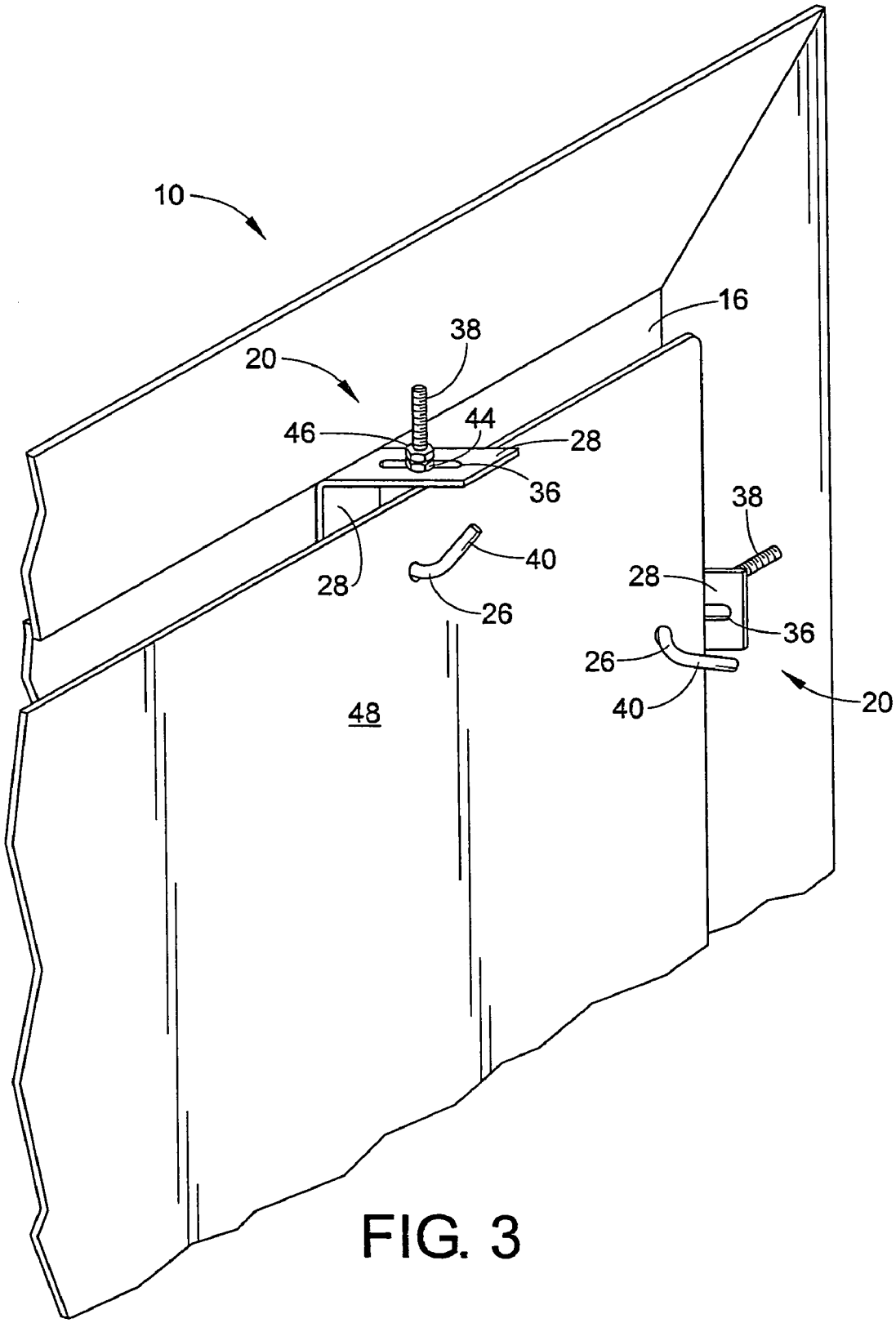
FIG. 3 is a partial perspective view of the billboard structure of FIG. 1 shown with a flexible material sign hung from the tension clips mounted on the billboard structure.

With additional reference to FIG. 3, a flexible material sign 48, which can be positioned on top of show surface 16, is shown connected to the billboard structure or frame 10 by the tension clamps 20. More specifically, the first leg sections 28 (only one being shown) are secured to the billboard structure 10 by the fasteners 34 (FIG. 1) such that the first leg sections 28 are in abutting and parallel relation with the show surface 16. With the first leg sections 28 abutting the show surface 16, the second leg sections 28 extend outwardly from the show surface in a direction approximately normal thereto. The J-bolts 26 pass through the slots 36 such that the threaded shaft sections 38 are generally parallel to the show surface and the hook sections 40 face outwardly away from the show surface.

A flexible material sign 48, such as a conventional vinyl sheet with preprinted advertisements or signage thereon, is secured to the billboard structure by passing the J-bolt hook sections 40 through the sign 48. To pass through the sign 48, the hook sections 40 pierce holes in the sign or, alternately, the sign can include holes prepositioned to correspond to the locations of the clamps 20 on the billboard structure 10. Optionally, grommets (not shown) can be used around the pierced holes or the prepositioned holes to reinforce the sign 48 and reduce the potential for tearing of the sign at or near the J-bolts.

With the sign 48 attached to the hook sections 40, the J-bolts 26 can be moved to a preselected location or position along the first and second axes. More specifically, each of the J-bolts can be moved within its respective slot along the first axis to position the sign 48 a selected distance from the show surface 16. Each of the J-bolts can also be threadedly moved along the second axis, and relative to a general plane of the respective second leg portion of each J-bolt, to apply a tension to the sign 48 for purposes of making the sign taut. When a particular J-bolt is in a desired preselected position, i.e., the sign 48 is taut and appropriately positioned relative to the show surface 16, the first threaded member 44 can be used to maintain the preselected position of that J-bolt. The tension force applied across the sign 48 and the counteracting force applied by the first threaded member 44 cooperate to maintain the J-bolt in the preselected position. The second threaded member 46 is used to lock the first threaded member in place and thereby lock the J-bolt in the preselected position.

To remove the sign 48 from the billboard structure 10, it is simply removed or pulled off its mounted relation with the J-bolts 26. The threaded members 44,46 can be threadedly moved to allow movement of the J-bolts 26 for purposes of releasing the tension on the sign 48 and facilitating ease of removal. When the sign 48 is removed, a new flexible material sign can be installed on the clamps 20 or, alternately, a pasted or painted sign can be applied to the show surface 16 directly over the first leg portions of the clamps 16.

Figure 4:
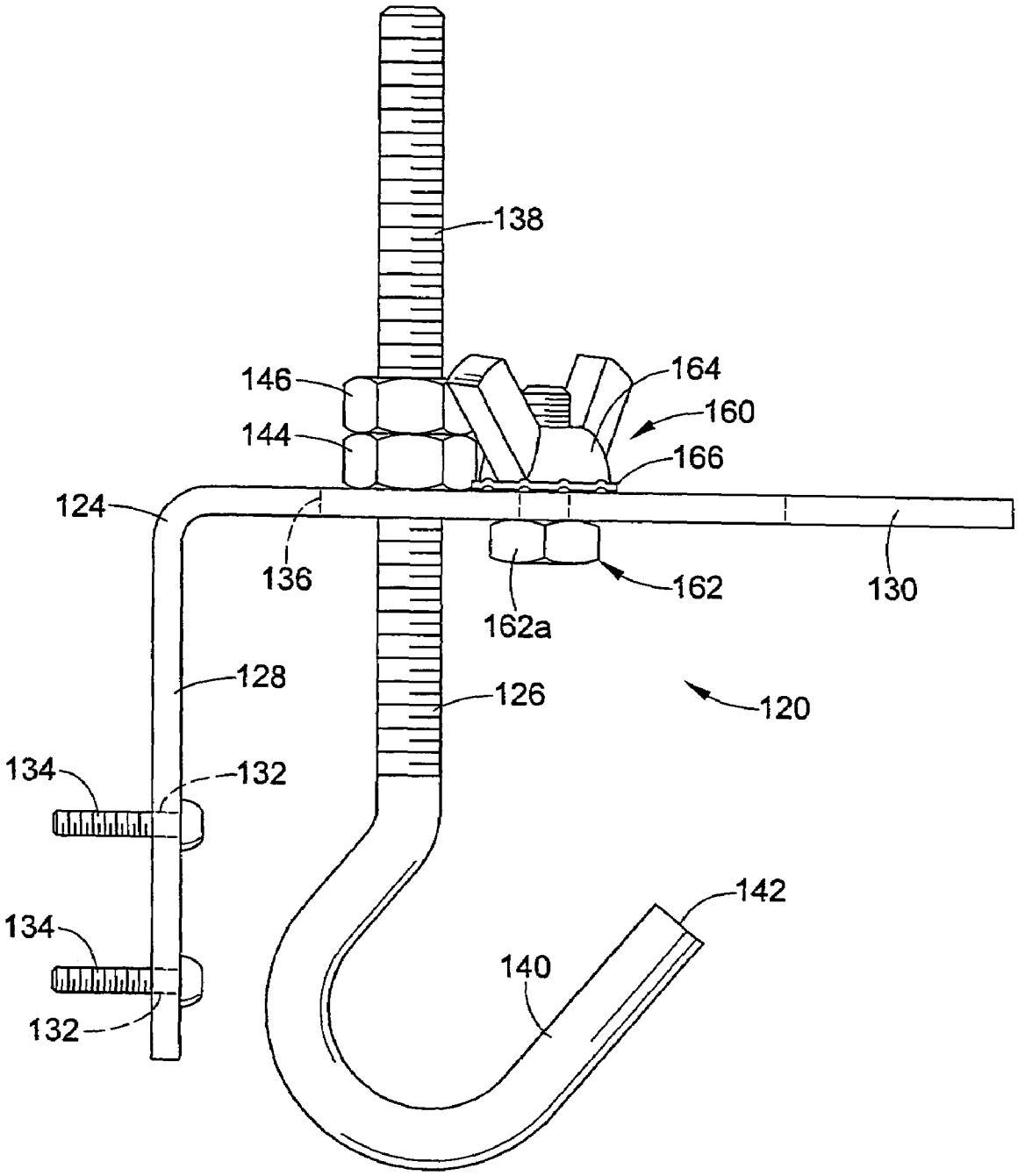
FIG. 4 is an elevational perspective view of a tension clamp according to an alternate embodiment.

With reference to FIG. 4, a tension clamp 120 is shown according to an alternate embodiment. The tension clamp 120 is generally the same or similar to the tension clamp 20, except as indicated below. The tension clamp 120 comprises an L-shaped bracket 124 and a J-bolt 126 moveably secured to the L-shaped bracket. Like the bracket 20, the bracket 120 includes a first leg section 128 and a second leg section 130 extending approximately normal relative to the first leg section. The first leg or clamp section 128 defines a plurality of apertures 132 therethrough (only two of three shown in hidden lines in the illustrated embodiment) for mounting the clamp 120 to a show surface of a billboard structure. Like the clamp 20, suitable fasteners 134 are received through the apertures 132 for securing the bracket 124 to the billboard structure.

The second leg section 130 defines a slot 136 (shown in hidden lines) extending along a longitudinal length of the second leg section. A width of the slot 136 is appropriately sized to receive a threaded shaft portion 138 of the J-bolt 126. Like the tension clamp 20, the J-bolt 126 is moveable along a first axis by moving into or out of the slot 136 and along a second axis parallel to the slot by moving along the slot. A hooked section 140 of the J-bolt is oriented such that an end 142 thereof faces outwardly in a direction opposite the first leg section 128. First threaded member 144 is threadedly received on the threaded shaft portion 138 of the J-bolt and abuts the second leg portion 130. Like the first threaded member 44, the first threaded member 144 maintains the J-bolt in a preselected position along both the first and second axis. A second threaded member or jamb nut 146 is also threadedly received on the threaded shaft portion 138 and is shown in an advanced position wherein the jamb nut is in abutting relation with the first threaded member 144 to effectively lock the J-bolt in the preselected position. Operation of the clamp 120, and its components or elements thus far described, occurs in the same or similar fashion as described in reference to the tension clamp 20.

The tension clamp 120 additionally includes a locking assembly 160 disposed on the bracket 124 to further limit movement of the J-bolt 126 along the slot 136. The locking assembly 160 includes a bolt 162 received through the slot 136 adjacent the J-bolt 126 and a threaded member 164 threadedly received on the bolt to lock the bolt in a desired position along the slot and to the bracket. The threaded member 164 can be a wing nut, as shown in the illustrated embodiment, to facilitate easier threaded advancement or removal of the threaded member onto or from the bolt. When locked in a desired position, the clamping assembly prevents the J-bolt 126 from moving beyond the clamping assembly in the slot 136, i.e., sliding away from a show surface to which the bracket 124 is attached. As shown in the illustrated embodiment, the clamping assembly can further include a locking washer 166 disposed on the bolt 162 axially between the threaded member and the bracket 124. Although not illustrated, a washer, such as a fender washer, can be disposed on the bolt axially between a head 162*a* of the bolt and the bracket 124. Such a washer, particularly one having a relatively large diameter, may be used to still further limit movement of the J-bolt 126 in the slot 136.

Although the invention has been specifically described and illustrated for use with a billboard structure, it is contemplated that the present invention could be employed in many other applications where it is desirable to hang a flexible material sign or banner. Moreover, the sizing and relative sizing of the components included in the tension clamp (including clamps 20 and 120) can vary and be adapted to the specific application in which the clamp is being employed. For example, a larger hook can be used in larger applications where higher wind loads may be anticipated. Further, it is expected that modifications and alterations will occur to others upon reading and understanding the preceding detailed description. Various presently unforeseen or unanticipated alternatives, modifications, variations or improvements may subsequently be made by those skilled in the art which are also intended to be encompassed by the following claims.

The invention claimed is:

1. A system for tautly mounting a flexible material sign to a billboard structure, comprising:

a plurality of tensioning clamps affixed to an associated billboard structure, each of said plurality of clamps including:

a bracket adapted to be secured to said associated billboard structure, and an adjustable J-bolt movably secured to said bracket, said J-bolt including a hooked section for passing through and hanging an associated flexible material sign to said associated billboard structure, wherein said J-bolt is adjustably movable along a first axis to selectively apply a tension to said associated flexible material sign to cause said associated sign to be taut between said plurality of tensioning clamps and wherein said J-bolt is further adjustably movable along a second axis for positioning said associated sign a selected distance from a show surface of said associated billboard structure.

2. The system of claim 1 wherein a first threaded member is threadedly received on a threaded section of said J-bolt to counteract a tension force applied to said sign for maintaining said J-bolt in a selected position along said first and second axes.

3. The system of claim 2 wherein a second threaded member is threadedly on said threaded section in abutting relation to said first threaded member to lock said J-bolt in said selected position along said first and second axes.

4. A system for tautly mounting a flexible material sign to a billboard structure, comprising:

a plurality of tensioning clamps affixed to an associated billboard structure, each of said plurality of clamps including:

an L-shaped bracket adapted to be secured to said associated billboard structure, said bracket having a first leg section secured to said billboard structure by at least one fastener and a second leg section extending in a direction away from said billboard structure, an adjustable J-bolt movably secured to said bracket, said J-bolt including a hooked section for passing through and hanging an associated flexible material sign to said associated billboard structure, said second leg section of said bracket having an aperture defined therein for receiving said J-bolt therethrough.

5. The system of claim 4 wherein said aperture is a slot extending in a direction approximately normal relative to a plane in which said associated flexible material sign resides, a locking assembly disposed on said bracket to limit movement of said J-bolt along said slot.

6. The system of claim 5 wherein said locking assembly includes a bolt received through said slot adjacent said J-bolt and a threaded member threadedly received on said bolt to lock said bolt in a desired position along said slot and to said bracket.

7. The system of claim 6 wherein said threaded member is a wing nut and an optional locking washer is disposed on said bolt axially between said wing nut and said bracket.

8. The system of claim 6 wherein a washer is disposed on said bolt axially between a head of said bolt and said bracket.

9. The system of claim 4 wherein said plurality of tensioning clamps permit a pasted or painted sign to be applied and viewed on said associated billboard structure when said plurality of tensioning clamps are not hanging said associated flexible material sign to said associated billboard structure.

10. A system for mounting a sign, comprising:

a first clamp affixed to a sign carrying structure, said first clamp including a first clamp bracket for securing said first clamp to said sign carrying structure and a first clamp hook adjustably secured to said bracket, said first clamp hook received through a first aperture in a flexible material sign to hang said sign; and a second clamp affixed to said sign carrying structure at a location spaced from said first clamp, said second clamp including a second clamp bracket for securing said second clamp to said sign carrying structure and a second clamp hook adjustably secured to said bracket, said second clamp hook received through a second aperture in said flexible material sign to further hang said sign, wherein said first and second clamp brackets are each L-shaped brackets and each include a clamp section affixed to said skin carrying structure by at least one fastener and a second section extending outwardly from said skin carrying structure, said second section defines an aperture therethrough for receiving a respective one of said first and second clamp hooks therethrough.

11. The system of claim 10 wherein said first and second clamp hooks are adjustably movable relative to their respective first and second clamp brackets to (i) apply a tension to said flexible material sign to cause said sign to be taut therebetween and (ii) position the sign a selected distance from said sign carrying structure.

12. The system of claim 10 wherein said first and second clamp hooks each include a threaded portion and a first threaded member threadedly received on said threaded portion to counteract tension of said sign.

13. The system of claim 12 wherein said first and second clamp hooks each further include a second threaded member threadedly received on said threaded portion in abutting relation to said first threaded member to lock said first threaded member in a desired position.

14. The system of claim 10 wherein said first and second clamp brackets each includes a leg section extending away from said sign carrying structure, said leg section defining a slot for receiving a respective one of said first and second clamp hooks therethrough, a clamping assembly including a bolt and a threaded fastener is also received through said slot to limit movement of said respective first and second clamp hooks along said slot.

15. The system of claim 14 wherein said clamping assembly further includes at least one of a fender washer and a locking washer.

16. A method for tautly mounting a flexible material sign to a billboard structure, comprising:

securing clamp brackets with J-bolts to the billboard structure with fasteners, each of said clamp brackets being an L-shaped bracket having a first leg section secured to the billboard structure by at least one fastener and a second leg section extending in a direction away from the billboard structure, said second leg section having an aperture defined therein for receiving a respective one of said J-bolts therethrough;

passing hooked sections of said J-bolts through the sign to hang the sign from the billboard structure; and adjusting said J-bolts relative to said clamp bracket to hang said sign a preselected distance from the billboard structure and to apply a tension to the sign to maintain a desired tautness of the sign.

17. The method of claim 16 further comprising:

positioning a first threaded member on a threaded portion of each J-bolt to maintain said J-bolt in a selected position; and positioning a second threaded member on said threaded portion to lock said J-bolt in said preselected position.

* * * * *

UNITED STATES PATENT AND TRADEMARK OFFICE

CERTIFICATE OF CORRECTION

PATENT NO. : 7,168,197 B2
APPLICATION NO. : 11/138716
DATED : January 30, 2007
INVENTOR(S) : John Siegenthaler It is certified that error appears in the above-identified patent and that said Letters Patent is hereby corrected as shown below:

In The Claims

Col. 7, line 42 “skin” should be --sign--.

Col. 7, line 44 “skin” should be --sign--.

Signed and Sealed this

Third Day of April, 2007

JON W. DUDAS
*Director of the United States Patent and Trademark Office*